United States Patent [19]

Dworak et al.

[11] 3,975,124

[45] Aug. 17, 1976

[54] GEAR MOTOR WITH VALVE CONTROLLED PRESSURE BIASED END SEALS FOR FACILITATNG STARTING OF THE GEAR MOTOR

[75] Inventors: Wilhelm Dworak, Stuttgart; Karl-Heinz Müller, Gerlingen, both of Germany

[73] Assignee: Robert Bosch G.m.b.H., Stuttgart, Germany

[22] Filed: Sept. 26, 1974

[21] Appl. No.: 509,738

[30] Foreign Application Priority Data

Oct. 1, 1973 Germany ..... 2349304

[52] U.S. Cl. ..... 418/132

[51] Int. Cl.[2] ..... F01C 19/08; F03C 3/00

[58] Field of Search ..... 418/131, 132, 133

[56] References Cited

UNITED STATES PATENTS

| | | | |
|---|---|---|---|
| 2,627,232 | 2/1953 | Lauck | 418/131 |
| 3,073,251 | 1/1963 | Weigert | 418/132 |
| 3,153,371 | 10/1964 | Miller | 418/133 |
| 3,174,408 | 3/1965 | Miller | 418/133 |
| 3,175,468 | 3/1965 | Miller | 418/133 |
| 3,209,698 | 10/1965 | Laumont | 418/131 |

*Primary Examiner*—John J. Vrablik
*Attorney, Agent, or Firm*—Michael J. Striker

[57] ABSTRACT

A housing of the gear motor accommodates a pair of meshing gears which are rotatably mounted in the interior of the housing and which each have a first and a second axial end face. Sealing elements are provided which are located proximal to the respective axial end faces, and an arrangement is provided for forming first fluid-pressure fields which press the sealing elements against the axial end faces. Adjacent at least one of these sealing elements there is provided a space in which an auxiliary fluid pressure field can develop, and an arrangement is provided by means of which the space can be pressurized when it is desired to form therein the auxiliary fluid pressure field so that the same may exert auxiliary pressure upon the associated sealing element to aid in pressing the same against the respective axial end face, and by means of which the space can be vented when such auxiliary pressure is not desired.

11 Claims, 4 Drawing Figures

40
38
34
32(26)
24(24')
5'
20'
A'
21(23)
37(37')
30'
30
28(28')
31
31'
29(29')
α
1
A''
5
5''
25(25')
33(27')
4
L

GEAR MOTOR WITH VALVE CONTROLLED PRESSURE BIASED END SEALS FOR FACILITATNG STARTING OF THE GEAR MOTOR

BACKGROUND OF THE INVENTION

The present invention relates to fluid-operated gear motors.

It is known to provide fluid-operated gear motors wherein at least at one axial end face of the gears there are provided sealing elements which engage this axial end face and which are pressed against the same by fluid pressure fields. In these machines of the prior art the forces acting from the fluid pressure fields upon the sealing elements, which can also be journalling elements for the gears, must be greater than those forces which develop in the interior of the motor and tend to lift or move the gears away from these sealing elements. Unless this relationship exists, there will be no proper sealing action and an excessive amount of fluid leakage will develop. When such motors are not in operation, that is when the gears are stationary, the frictional forces acting upon the gears are much higher — due to the existing static friction — then when the gears are in rotation. This means that when such a motor is started up, it can start up only slowly and in some instances the frictional forces may be so high that starting of the gears in rotation may even be blocked. It is evident that this is highly disadvantageous; nevertheless, to a greater or lesser degree substantially all gear motors of the prior art which are constructed as outlined above, are subject to this disadvantage.

SUMMARY OF THE INVENTION

Accordingly, it is an object of the present invention to overcome the disadvantages of the prior art.

More particularly, it is an object of this invention to provide an improved fluid-operated gear motor which is not possessed of these disadvantages.

In particular, it is an object of the invention to provide such an improved gear motor which can start up much more readily than those known from the prior art.

A particularly important object of the invention is to provide such a gear motor which will start up without delay or retardation, and without jolts or jerks.

In keeping with these objects, and with others which will become apparent hereafter, one feature of the invention resides in a fluid-operated gear motor which, briefly stated, comprises a housing having an interior, a pair of meshing gears rotatably mounted in this interior and each having first and second axial end faces, and first and second sealing means proximal to the respective axial end faces. First means is provided for forming first fluid-pressure fields which press the sealing rings against the axial end faces. Thus far, the construction of the fluid motor is known.

However, according to the present invention there is provided second means which forms adjacent at least one of the sealing means a space for development of an auxiliary fluid-pressure field, and third means for pressurizing this space when it is desired to form therein the auxiliary fluid-pressure field so that the same may exert auxiliary pressure upon the one sealing means to aid in pressing the same against the associated end face, and for venting this space when such auxiliary pressure is not desired.

The gear motor according to the present invention thus has the advantage that the forces exerted by the first fluid-pressure fields can be brought into equilibrium with the forces tending to lift the axial end faces of the gears off or move them away from the sealing means, when the space for the development of the auxiliary fluid-pressure field is vented, so that the frictional forces tending to retard the rotation of the gears during starting-up are substantially decreased. Moreover, the leakage losses in operation of the novel gear motor are significantly reduced due to the fact that, when the space is pressurized and the auxiliary fluid-pressure field develops therein, the pressure exerted by this auxiliary fluid-pressure field will be added to that of the first fluid-pressure fields and will therefore press the sealing means more firmly against the associated axial end faces of the gears.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
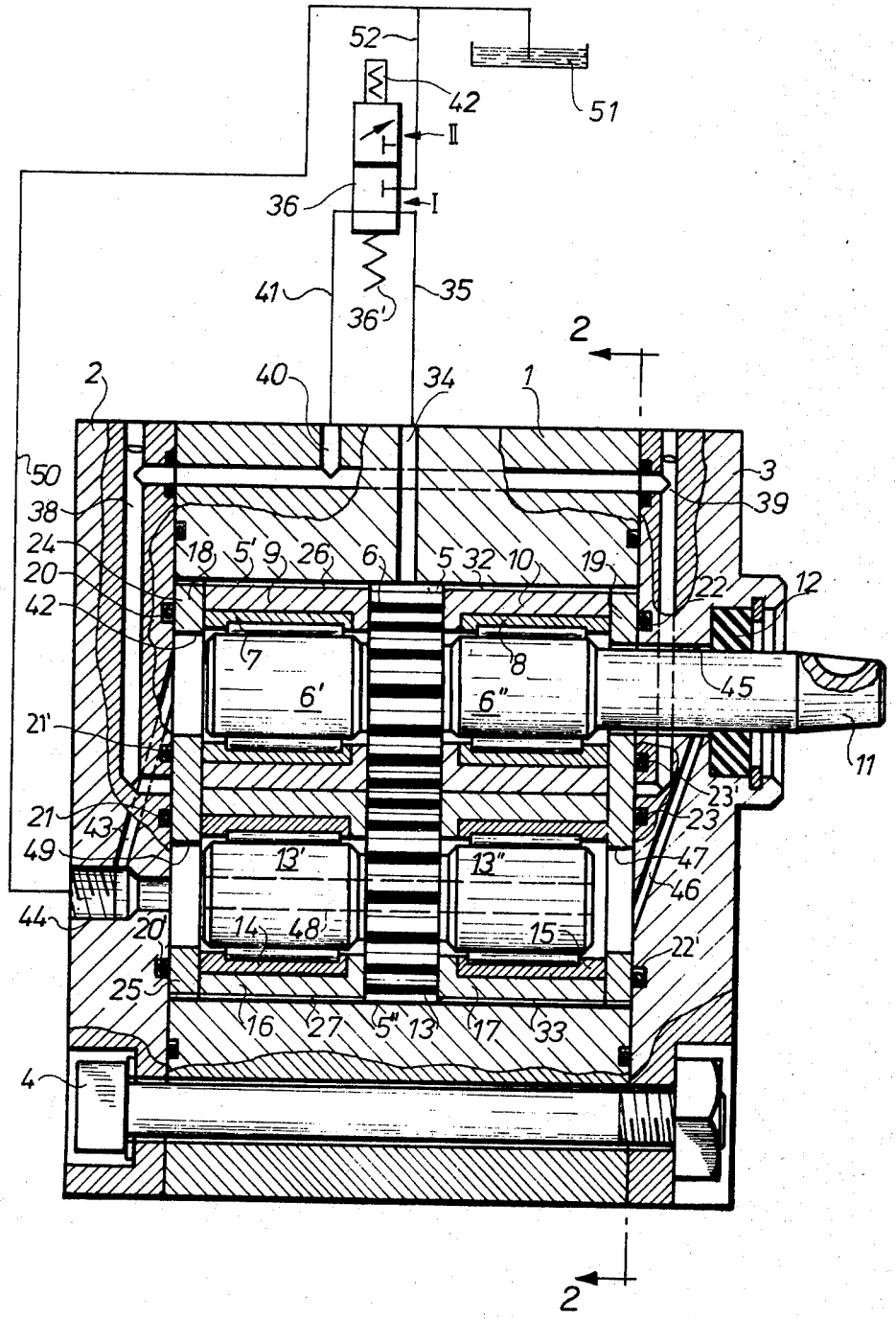
FIG. 1 is an axial section through a gear motor according to the present invention.
Figure 2:
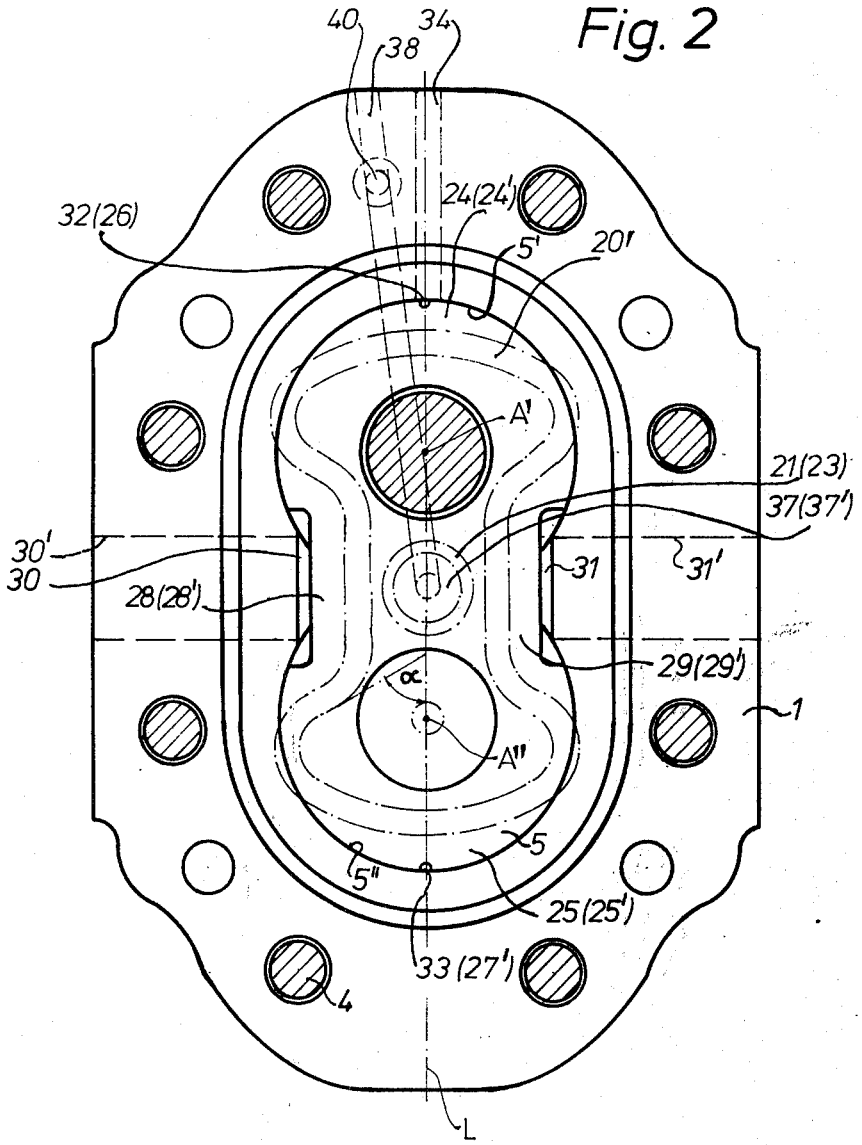
FIG. 2 is a section taken on line II—II of FIG. 1.
Figure 4:
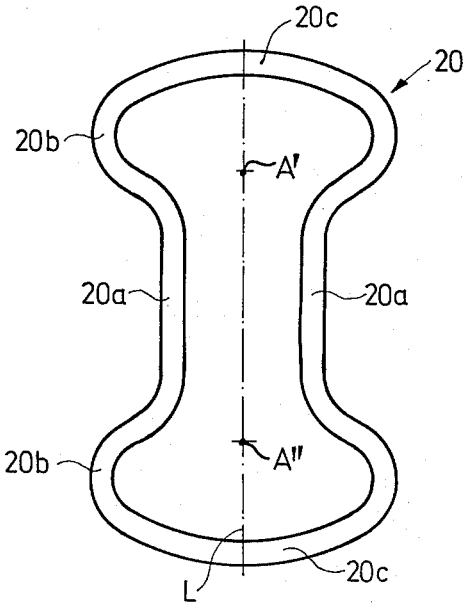
FIG. 4 is a diagrammatic showing of one of the sealing elements used in the novel gear motor.

Referring now to the drawing in detail, and firstly to FIGS. 1, 2 and 4, it will be seen that reference numeral 1 identifies a housing having an interior 5. The housing has opposite open ends which are closed by end covers 2 and 3, respectively. The end covers 2 and 3 are held in place by being connected with the main housing body 1 by means of bolts 4 (one shown).

The interior 5 of the housing is so shaped as to form two intersecting cavities 5′, 5″ so that the two cavities together resemble a figure eight. Arranged in the cavity 5′ is a gear 6 whose shafts 6′, 6″ are journalled in needle bearings 7, 8 which are press fitted into sleeves 9, 10 that engage the opposite axial end faces of the gear 6. The shaft 6″ projects through the end cover 3 to form an output shaft 11; a shaft seal 12 is provided to seal the opening through which the output shaft 11 extends.

A further gear 13 is journalled with its shafts 13′, 13″ in needle bearings 14, 15 which are press fitted into sleeves 16, 17 that also engage the opposite axial end faces of the gear 13. The teeth of the gear 13 mesh with the teeth of the gear 6 as is known from the art of gear pumps and gear motors. Located between the sleeves 9, 16 and the cover 2 is a pressure plate 18, and a similar pressure plate 19 is located between the sleeves 10, 17 and the end cover 3; the outline of the pressure plates 18, 19 corresponds to the cross-sectional contour of the interior 5.

The inwardly facing side of the end cover 2 is formed with a circumferentially complete groove 20′ (see FIG.

2) in which there is arranged a sealing element 20 having, as FIG. 4 shows, essentially the configuration of a barbell. The sealing element 20 is arranged symmetrically with reference to a line L connecting the axis A' and A'' of the two gears 6, 13 and is also arranged symmetrically with reference to a line extending normal to the line L and intersecting the latter midway between the axis A', A''. As more clearly shown in FIG. 4, the sealing element 20 has a pair of straight portions 20*a* located intermediate the shafts 6' and 13' and which are spaced from one another by a distance corresponding approximately to the diameter of the shafts 6', 13'; the portions 20*a* extend in parallelism with the line L. The element 20 further has two curved end portions 20*c* which are joined with the respective straight portions 20*a* by inclined portions 20*b* that diverge in direction outwardly away from the line L. The portions 20*b* intersect the contour of the housing interior 5 and each of the portions 20 includes with the line L an angle $\alpha$ of approximately 60°. Where the sealing element 20 intersects the contour of the housing interior 5, or rather the contour of the cavities 5', 5'', it has a radius which is greater than that of cavities 5', 5'' and whose center is so arranged that there will be formed respective sickle-shaped spaces 24, 25 opposite the pressure plate 18. The junctures between the portions 20*a*, 20*b* and 20*c* of the sealing element 20 are rounded, as shown in FIG. 4.

The inwardly facing side of the cover 2 is further provided with a second groove 21' which is circular and circumferentially complete; the center of the circle surrounded by the groove 21' coincides with the line L, and the groove 21' is located in the space intermediate the straight portions 20*a*. A circumferentially complete sealing element 21 is received in the groove 21'.

The end cover 3 is formed with a groove 22' corresponding to the groove 20' which accommodates a sealing element 22 corresponding to the sealing element 20. The inwardly facing side of the end cover 3 is further provided with a circumferentially complete circular groove 23' corresponding to the groove 21' and wherein a further circular sealing element 23 is arranged which corresponds to the sealing element 21. The sealing element 22 forms adjacent the pressure plate 19 sickle-shaped spaces 24', 25' which correspond to the spaces 24, 25.

It should be understood that the grooves 21' and 23' and the sealing elements 21, 23 need not absolutely be circular, and need also not be symmetrical with reference to the line L; a different configuration can be chosen as long as an effect is obtained which corresponds to the effect of the sealing elements 21, 23 that have been illustrated.

First fluid-pressure fields develop in the spaces 24, 25 and also in the spaces 24', 25'. The fluid pressure fields in the spaces 24, 25 receive high pressure fluid which can flow out of the gaps between meshing teeth of the gears 6, 13 and enter the spaces 24, 25 via a groove 26, 27 which is formed in the sleeves 9, 16 and the pressure plate 18 and extends axially of the gears 6, 13. Pressure fields 28, 29 develop along the longitudinal sides of the pressure plate 18, intermediate the contour of the housing interior 5 and the inner circumference of the sealing element 20; these pressure fields 28, 29 receive fluid from openings 30, 31 which each communicate with a bore 30', 31' for the inflow or outflow of pressure fluid. In dependence upon whether the openings 30, 31 are high pressure or low pressure openings, the pressure field 28 is a high pressure field and the pressure field 29 a low pressure field, or vice versa.

Grooves 32, 33 are formed in the sleeves 10 and 17 and in the pressure plate 19. These grooves 32, 33 correspond to the grooves 26, 27 and serve to supply pressure fluid to the spaces 24', 25' which are not separately shown but whose presence is indicated by the listing of their reference numerals in FIG. 2, so that corresponding pressure fields develop therein. Similarly, along the longitudinal sides of the pressure plate 19 pressure fields 28', 29', will develop which correspond to the pressure fields 28, 29 and which also receive fluid from the openings 30 and 31 and are each either a high pressure field or a low pressure field.

A bore 34 extends from the interior of the housing body 1 to the exterior and is so located that as the gears rotate, those tooth gaps of the gears will move past the opening 34 which are at high pressure. The bore 34 communicates via a fluid line 35 with a three-port, two-position valve 36 which is maintained by a biasing spring 36' in its first operating position I, and can be electromagnetically switched to its second operating position II at the will of a user. However, instead of an electromagnetic switch arrangement a mechanical or hydraulic arrangement could also be utilized for this purpose.

The sealing elements 21, 23 surround and define the auxiliary pressure fields 37, 37' on the pressure plates 18, 19 which pressure fields receive pressure fluid via channels 38, 39. These channels communicate with a bore 40 which in turn is connected with the valve 36 by means of a fluid line 41.

Leakage fluid flowing out of the tooth gaps of the gear 6 axially of the latter travels at one end of the gear 6 to an opening 42 in the pressure plate 18, and from there via a channel 43 to an outlet 44. At the other axial end of the gear 6 the leakage fluid travels to a bore 45 through which the output shaft 11 extends, and the fluid then collects behind (i.e. inwardly of) the shaft seal 12 from where it flows through a further channel 46 to an opening 47 in the pressure plate 9, to travel from there via a bore 48 that penetrates the gear 13 and the shafts 13', 13'' thereof, traversing the gear 13 and the shafts axially and travelling through an opening 49 of the pressure plate 18 to finally also enter into the outlet 44. The leakage fluid which flows out of the tooth gaps of the gear 13, on the other hand, travels at one axial end of the gear 13 via the bore 48 and the opening 49, and at the other axial end of the gear 13 via the opening 49 into the outlet 44. All of the leakage fluid flows from the outlet 44 via a fluid line 50 to a fluid reservoir 51 which is connected via a further fluid line 52 with the valve 36.

The valve 36 in FIG. 1 is so constructed that in its operating position I it connects the fluid line 35 with the fluid line 41, and blocks the line 52. In its second operating position II the valve 36 connects the fluid line 41 with the fluid line 52 leading to the reservoir 51, whereas it blocks the fluid lines 35.

When the gear motor of FIGS. 1–2 and 4 receives pressure fluid at high pressure via one of the bores 30', 31', then — in dependence upon the flow direction of the pressure fluid — pressure fields 24, 25 are for instance developed on the pressure plate 18, as well as the pressure fields 28 and 29. These fields press the sleeves 9, 16 against the adjacent axial end faces of the gears 6, 13. It should be understood that for purposes of the appended claims the sleeves 9, 16 are considered part of the sealing components of the gear motor. The dimensioning of the pressure fields is so selected that the force with which they press the sleeves 9, 16 against the gears 6, 13 compensates for the pressures which are exerted by the pressure medium in the tooth gaps of the gears 6, 13 that are at high pressure, and which act upon the sleeves 9, 16 in a sense tending to move the same apart from the axial end faces of the gears 6, 13. The pressure fields 24', 25', 28', 29' and 37', which develop on the pressure plate 13 correspond exactly to the pressure fields 24, 25, 28, 29 and 37 on the pressure plate 18, and have the same effect but with respect to the opposite axial end faces of the gears 6, 13 and with reference to the sleeves 10 and 17, rather than the sleeves 9, 16. When the pressure field 37 is at high pressure it exerts an auxiliary pressure via the plate 18 upon the sleeves 9, 16 to press the same more firmly against the adjacent axial end faces of the gears 9, 16. In this case, the forces exerted upon the sleeves 9, 16 in a sense pressing the same against the adjacent axial end faces of the gears 6, 13 are greater than the counter forces of the fluid tending to lift the sleeves out of engagement with the gears, so that the sleeves 9, 16 are in tight engagement with the axial end faces of the gears and leakage losses are low. The same is of course true for the pressure field 37' on the plate 19.

The biasing spring 36' normally urges the valve 36 to maintain its starting position I in which the valve connects the fluid line 35 with the line 41, so that the pressure fields 37, 37' are at high pressure and the auxiliary pressure described above will develop. In this case the sleeves 9, 10 and 16, 17 are then pressed tightly against the corresponding axial end faces of the gears 6, 13, thereby reducing the leakage losses as compared to what they would be if the pressure were only exerted by the other pressure fields and not by the additional auxiliary pressure derived from the pressure fields 37, 37'.

This pressure increase resulting from the provision of the auxiliary pressure exerted by the fluid pressure fields 37, 37' is advantageous when the motor operates, because it will reduce the leakage losses as just pointed out above. However, when the motor is at a standstill and is to be started up, the auxiliary pressure added to the pressure exerted by the fluid pressure fields other than the pressure fields 37, 37' will produce frictional forces which may either prevent the start-up of the motor or else make it very difficult and slow. According to the present invention this problem is avoided in that, when the motor is to be started up, the valve 36 is moved one or more times for brief periods to its position II, for example in FIG. 1 by actuating the electromagnet which is associated with the valve 36 and which effects such movement counter to the force of the spring 36'. In the position II the valve connects the pressure fields 37, 37' via the fluid lines 41 and 52 with the reservoir 51; in other words, the spaces in which the pressure fields 37, 37' exist or develop are now vented to the low-pressure reservoir 51, so that the pressure fields 37, 37' briefly do not exert the auxiliary pressure, thus reducing the increased friction and permitting the motor to start up readily and without any complications. Subsequently the valve 36 of course returns to and remains in its starting position I, and the auxiliary pressure aids in more firmly pressing the sleeves 9, 10, 16, 17 against the corresponding axial end faces of the gears 6, 13, thus significantly decreasing the leakage losses.

It will be appreciated that the results would be the same if the gears 6, 13 were not journalled in separate sleeves 9, 10, 16, 17, but instead were journalled in some other way, for instance in journalling bodies of which one is provided at each axial end of the gears and of which each body journals both gears together.

Figure 3:
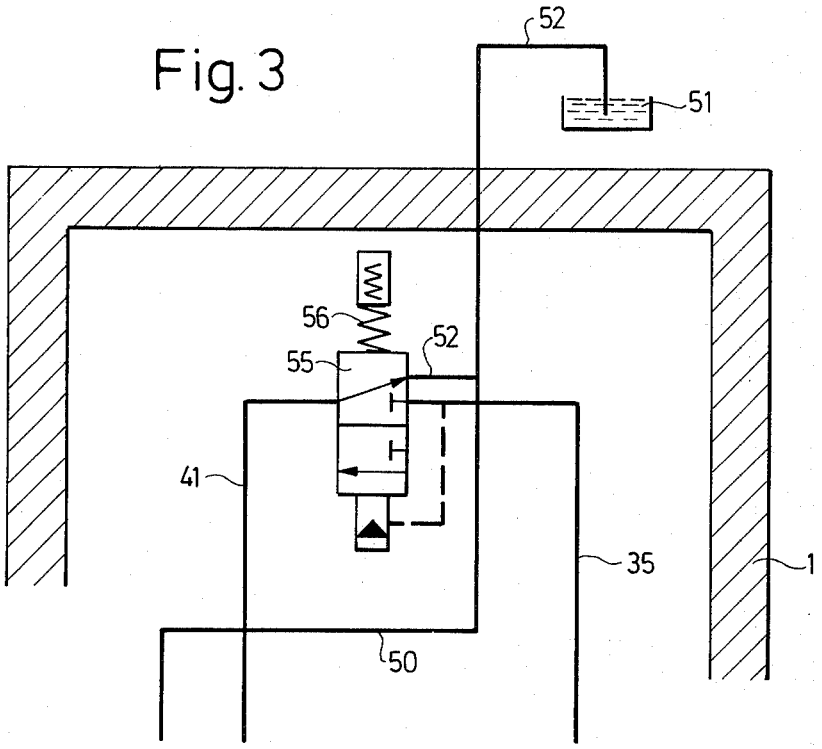
FIG. 3 illustrates a valve for use with the gear motor of FIGS. 1 and 2, but of a slightly different type than the valve illustrated in those Figures.

FIG. 3 shows a three-port, two-position valve 55 which can also be used with the motor of FIGS. 1 and 2 in lieu of the valve 36. It will be understood that the smallest possible resistance to start-up of the gear motor when the same is not under load depends upon the magnitude of the auxiliary pressure fields 37, 37'. Starting-up is therefore simplified, if the pressure fields 37, 37' remain at low pressure until the smallest starting pressure in the motor has been reached and the motor is actually turning over. This can be achieved by utilizing the valve 55 of FIG. 3 which can be operated at will electromagnetically in known manner, and which is automatically also switchable by hydraulical means.

The valve 55 again has two operating positions and is maintained in its starting position by the biasing spring 56. In this starting position the spaces for the pressure fields 37, 37' (not shown in FIG. 3) are connected via the fluid lines 41 and 52 with the reservoir 51, so that they are at low pressure. When the smallest possible and required starting pressure for the motor has been reached in the fluid line 35, which is always at the pressure of the high-pressure side of the motor, the valve 55 is automatically switched to its other position in which it connects the fluid lines 35 and 41 with one another, so that the spaces for the pressure fields 37, 37' will now be subjected to this starting pressure.

If the gear motor must start under load, then the valve is also hydraulically switched when the smallest possible starting pressure is reached in the motor and hence in the fluid line 35, except that now the required starting pressure will of course be higher because the motor starts under load. In this case, however, the valve 55 is now electromagnetically switched back to its first or starting position for brief periods of time, one or several times, so that during these periods of time the fluid line 51 is connected with the reservoir 51 via the fluid line 52, and the spaces for the pressure fields 37, 37' are at the low pressure of the reservoir, so that the motor can start more readily. This brief switching of the valve 55 back to its starting position can of course be accomplished in ways other than electromagnetically, for instance mechanically or hydraulically.

Irrespective of which of the valves is utilized in the novel gear motor, that is the valve 36 of FIGS. 1 and 2 or the valve 55 of FIG. 3, it should be understood that the valve may either be located outside the housing composed of the housing body 1 and the end covers 2, 3, as is shown in the embodiment of FIG. 1, or that it can be located within the housing composed of the housing body 1 and the end covers 2 and 3, for example in a protrusion formed for this purpose in the housing body 1, as is diagrammatically illustrated in FIG. 3. How the fluid lines can be extended through the housing in such case, that is to extend to the reservoir 51, will be evident from a comparison of FIG. 3 with the showing in FIG. 1.

It will be understood that each of the elements described above, or two or more together, may also find a useful application in other types of constructions differing from the types described above.

While the invention has been illustrated and described as embodied in a fluid-operated gear motor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A fluid operated gear motor comprising a housing having an interior and a high pressure side and a low pressure side; a pair of meshing gears rotatably mounted in said interior and having first and second axial end faces; first and second sealing means engaging the respective axial end faces; first means for forming first fluid-pressure fields which press said sealing means against said axial end faces; second means forming adjacent at least one of said sealing means a space for development of an auxiliary pressure field separated from said first pressure fields; and a valve selectively movable between a first position connecting said space with a said low pressure side until a predetermined starting pressure of fluid has developed in said motor and for subsequently connecting said space to said high pressure side, said valve comprising spring means for normally biasing said valve to one of said positions and actuating means for moving said valve to the other of said positions.

2. A gear motor as defined in claim 1, wherein said gears have spaced parallel axes of rotation and said motor has a high-pressure side and a low-pressure side; and wherein said space is located substantially midway between said axes.

3. A gear motor as defined in claim 1, wherein said space is of circular outline and bounded by a sealing ring which is partially recessed into a groove formed in said housing.

4. A gear motor as defined in claim 1, wherein said interior of said housing is at a pressure during operation of the motor which counteracts and is in equilibrium with the pressure exerted by said first fluid-pressure fields when said space is vented, and wherein the combined pressure exerted by said first fluid-pressure fields and said auxiliary fluid-pressure field is greater than said pressure at the interior of said housing when said space is pressurized.

5. A gear motor as defined in claim 1, said housing including a housing body having spaced open ends and a pair of covers each closing one of said ends, said housing body and covers being provided with a first fluid channel for supplying pressure fluid to said space, and said housing body being formed with a second fluid channel communicating with the high-pressure side of said motor; and further comprising fluid-lines connecting each of said channels with said valve.

6. A gear motor as defined in claim 1, wherein said first and second sealing means comprises journalling means journalling said gears for rotation in said housing and pressure plates intermediate said journalling means and portions of said housing, said pressure plates being juxtaposed with the respective axial end faces of said gears, and wherein said pressure fields develop intermediate said pressure plates and said portions of said housing.

7. A fluid operated gear motor as defined in claim 1, wherein said spring means normally biases said valve to said first position.

8. A fluid operated gear motor as defined in claim 1, wherein said spring means normally biases said valve to said second position.

9. A gear motor as defined in claim 1, wherein said valve is a three-port, two-position valve.

10. A gear motor as defined in claim 9, wherein said valve is located outside said housing.

11. A gear motor as defined in claim 9, wherein said valve is located within said housing.

* * * * *